US005733160A

United States Patent [19]

Jeng et al.

[11] Patent Number: 5,733,160

[45] Date of Patent: Mar. 31, 1998

[54] METHOD OF FORMING SPACERS FOR A FLAT DISPLAY APPARATUS

[75] Inventors: Shin-Puu Jeng; Johnson J. Lin, both of Plano; Bruce E. Gnade, Dallas; Dennis L Robbins, Richardson, all of Tex.

[73] Assignee: Texas Instruments Incorporated, Dallas, Tex.

[21] Appl. No.: 609,663

[22] Filed: Mar. 1, 1996

[51] Int. Cl.[6] ..... H01J 1/30

[52] U.S. Cl. ..... 445/24; 445/25

[58] Field of Search ..... 445/24, 25; 228/180.5

[56] References Cited

U.S. PATENT DOCUMENTS

| | | | |
|---|---|---|---|
| 3,755,704 | 8/1973 | Spindt et al. | 313/309 |
| 4,091,305 | 5/1978 | Poley et al. | 313/220 |
| 4,099,082 | 7/1978 | Chodil et al. | 313/217 |
| 4,183,125 | 1/1980 | Meyer et al. | 29/25.15 |
| 4,422,731 | 12/1983 | Droguet et al. | 350/344 |
| 4,451,759 | 5/1984 | Heynisch | 313/495 |
| 4,857,799 | 8/1989 | Spindt et al. | 313/495 |
| 4,940,916 | 7/1990 | Borel et al. | 313/306 |
| 4,955,523 | 9/1990 | Calomagno et al. | 228/180.5 |
| 5,063,327 | 11/1991 | Brodie et al. | 313/482 |
| 5,194,780 | 3/1993 | Meyer | 315/169.3 |
| 5,225,820 | 7/1993 | Clerc | 340/752 |
| 5,232,549 | 8/1993 | Cathey et al. | 456/633 |
| 5,329,207 | 7/1994 | Cathey et al. | 445/24 |
| 5,371,433 | 12/1994 | Horne et al. | 313/495 |
| 5,448,131 | 9/1995 | Taylor et al. | 313/309 |
| 5,484,314 | 1/1996 | Farnworth | 445/24 |
| 5,486,126 | 1/1996 | Cathey et al. | 445/25 |

OTHER PUBLICATIONS

Tummala et al., *Microelectronics Packaging Handbook*, 1989, pp. 393–395.

*Primary Examiner*—Kenneth J. Ramsey
*Attorney, Agent, or Firm*—Christopher L. Maginniss; W. James Brady, III; Richard L. Donaldson

[57] ABSTRACT

A method disclosed herein for making a spacer 30 useful for maintaining a fixed spacing between the cathode 12 and anode 10 structures of a flat display. The method includes the steps of melting an end of a glass filament 40 held in the bore of a capillary 42, urging the melted end 46 against the surface 23 of the cathode structure 12 to form a bond thereon, and severing the filament 40 at a fixed distance h from the surface 23 to thereby form an upright spacer 30. The severing step may be accomplished by tilting or twisting the capillary 42 until the filament 40 is severed, or by cutting the filament 40 with a torch flame 54. The bonding process may be enhanced by preheating the cathode structure 12 and/or by subjecting the cathode structure 12 to ultrasonic vibration during bonding.

24 Claims, 3 Drawing Sheets

METHOD OF FORMING SPACERS FOR A FLAT DISPLAY APPARATUS

TECHNICAL FIELD OF THE INVENTION

The present invention relates generally to flat panel displays and, more particularly, to a method of forming glass post spacers on a substrate for maintaining a fixed spacing between the emitter assembly and the display face of a substantially evacuated flat panel display.

BACKGROUND OF THE INVENTION

Advances in field emission display technology are disclosed in U.S. Pat. No. 3,755,704, "Field Emission Cathode Structures and Devices Utilizing Such Structures," issued 28 Aug. 1973, to C. A. Spindt et al; U.S. Pat. No. 4,940,916, "Electron Source with Micropoint Emissive Cathodes and Display Means by Cathodoluminescence Excited by Field Emission Using Said Source," issued 10 Jul. 1990 to Michel Borel et al; U.S. Pat. No. 5,194,780, "Electron Source with Microtip Emissive Cathodes," issued 16 Mar. 1993 to Robert Meyer; and U.S. Pat. No. 5,225,820, "Microtip Trichromatic Fluorescent Screen," issued 6 Jul. 1993, to Jean-Frédéric Clerc. These patents are incorporated by reference into the present application.

It is important in flat panel displays of the field emission cathode type that the electron emitting surface and the opposed display face be maintained insulated from one another at a relatively small but uniform distance throughout the full extent of the display face. There is a relatively high voltage differential, generally on the order of 200–5,000 volts, between the emitting surface and the display face, and it is vital that electrical breakdown between these two surfaces be prevented. However, the spacing between the anode and cathode has to be small to assure that the desired thinness, high resolution and color purity are achieved. This spacing also has to be uniform for uniform resolution, brightness, to avoid display distortion, etc. Nonuniformity in spacing is much more likely to occur in a field emission cathode, matrix-addressed, flat vacuum-type display than in some other gas-filled display types, since there is typically also a high differential pressure on the opposite sides of the display face. Whereas the exposed side of such face may be at atmospheric pressure, a high vacuum of approximately $10^{-7}$ torr may be present between the emitting surface and the display face of the field emission flat panel display structure.

In general, spacer arrangements of the prior art for field emission-type cathode flat panel displays may be divided into two categories: spacer structures which are formed as an integral part of either the emitting structure or the anode structure, and those which are separate from both of these structures, and which are placed between the two during final assembly. In the former category, U.S. Pat. No. 4,857,799, "Matrix-Addressed Flat Panel Display," issued 15 Aug. 1989, to C. A. Spindt et al., describes a spacer approach in which elongated, parallel legs are provided integrally connected with the display face plate interspersed between adjacent rows of pixels. Another approach, disclosed in U.S. Pat. No. 4,091,305, "Gas Panel Space Technology," issued 23 May 1978, to N. M. Poley et al., for a gaseous discharge type of flat panel display, uses a metal to connect spacers, which metal is then coated with a dielectric layer. This approach is not conducive to being used in a field emission type arrangement, because of the high voltage differential necessary between the anode and cathode of such an arrangement. This high voltage can exceed the breakdown potential of the dielectric and result in the metal of the spacer posts causing an electrical short between the faceplate and the cathode emitting surface.

Another approach in this category, disclosed in U.S. Pat. No. 4,422,731, "Display Unit With Half-Stud, Spacer, Connection Layer and Method of Manufacturing," issued 27 Dec. 1983, to J. P. Drogeut et al., is to provide interacting spacer parts on the display face and the cathode construction. U.S. Pat. No. 4,451,759, "Flat Viewing Screen With Spacers Between Support Plates and Method of Producing Same," issued 29 May 1984, to H. Heynisch, shows such an arrangement for a flat panel display in which metal pins on the face register with hollow cylinders projecting from the cathode. Finally, U.S. Pat. No. 5,063,327, "Filed Emission Cathode Based Flat Panel Display Having Polyimide Spacers," issued 5 Nov. 1991, to I. Brodie et al., discloses polyimide spacers or pillars separating the emitting surface an the display face of a flat panel display.

Many of these prior art approaches of the first-mentioned category have registration problems, and all of them add a level of complexity to the fabrication of the cathode and/or anode structure.

In the latter category of prior art spacer arrangements, those which are separate from both the cathode structure and the anode structure, U.S. Pat. No. 4,183,125, "Method of Making an Insulator-Support for Luminescent Display Panels and the Like," issued 15 Jan. 1980, to R. L. Meyer et al., discloses a spacer comprising a stack of glass filaments, which are mutually bonded to form a unitary cellular latticework.

In another prior art method of this latter category known to the applicants, uniform spacing between a field emission structure and an anode structure is provided by a multiplicity of glass spheres used as spacers between the cathode plate and the anode plate. These glass spheres, illustratively 200 microns in diameter, serve the dual purposes of providing voltage isolation between the plates, and also provide the standoff of the mechanical forces of vacuum on the two plates. The use of glass spheres as spacers provides a distinct advantage over the pillar structures of the prior art of the first-mentioned category cited above. This advantage is the relative invisibility of the glass spheres in the presence of an electron beam.

The use of spheres as spacers presents a significant problem when their diameters are not exactly uniform, and one sphere, slightly larger than others in its vicinity, is burdened with an inordinate amount of pressure maintaining the spacing between the plates. In this situation, it is not uncommon for the sphere to be crushed, introducing loose glass fragments within the display device.

U.S. Pat. No. 5,448,131, "Spacer for Flat Panel Display," issued 5 Sep. 1995, to R. H. Taylor et al., discloses a spacer which comprises a comb-like structure having a plurality of elongated filaments joined to a support member, thereby providing ease of handing and assembly. The filaments, which may be glass, are positioned longitudinally in a single layer between the facing surfaces of the plates of a display. In an embodiment disclosed in the Taylor et al patent, the filaments are of nonuniform diameter such that they contact the facing surfaces only at the high spots, thereby reducing shadowing on the display surface.

The attractiveness of the spacer arrangements of the latter category, those which are separate from both the cathode structure and the anode structure, begins to suffer as the spacing between the plates of the display is increased. Such an increase has been found to be necessary in order to allow a sufficiently high anode voltage for adequate display brightness. While a 200-micron spacing is appropriate for low brightness applications, spacings of one-half or even one millimeter may be required for higher brightness applications. Such a display would require one-half or one millimeter diameter glass sphere spacers, or filaments of that diameter, in the case of the Taylor et al patent, which size would clearly occult a noticeable portion of the display.

In view of the above, it is easily understood that there exists a need for an apparatus for maintaining a uniform spacing between the emission surface and the anode of a field emission flat panel display device which is relatively simple to manufacture, and which is effective even where the spacing distance between the facing surfaces of the plates approaches and even exceeds the spacing between adjacent pixels on the display screen.

SUMMARY OF THE INVENTION

In accordance with the principles of the present invention, there is disclosed herein a method for making a spacer useful for maintaining a fixed spacing between two substantially parallel plates, the method comprising the steps of: providing a substrate; melting an end of a fiber being held in the bore of a capillary; urging the melted end against the substrate to form a bond thereon; and severing the fiber at a fixed distance from the substrate.

In accordance with one embodiment of the present invention, the step of melting an end of the fiber comprises heating the end with a torch flame so as to form a ball at the end, and the step of urging the melted end against the substrate includes positioning the capillary so as to apply force on the ball against the substrate. In accordance with a preferred embodiment of the present invention, the step of urging the melted end against the substrate further includes ultrasonically agitating the substrate to assist formation of the bond.

In accordance with one embodiment of the present invention, the step of severing the fiber at a fixed distance from the substrate includes positioning the capillary at the fixed distance from the substrate, and tilting the capillary until the fiber is severed. In accordance with another embodiment of the present invention, the step of severing the fiber at a fixed distance from the substrate includes positioning the capillary at the fixed distance from the substrate, and twisting the capillary until the fiber is severed. In accordance with still another embodiment of the present invention, the step of severing the fiber at a fixed distance from the substrate includes cutting the fiber with a torch flame.

Further in accordance with the present invention there is disclosed a method for fabricating a flat display apparatus comprising the steps: of providing a substrate having a substantially planar surface; providing a display panel having a substantially planar face; providing a spacer element on one of the substantially planar surface and substantially planar face comprising the substeps of melting an end of a fiber being held in the bore of a capillary, urging the melted end against the one of the substantially planar surface and substantially planar face to form a bond thereon, and severing the fiber at a fixed distance from the one of the substantially planar surface and substantially planar face; repeating the previous step at various locations on the one of the substantially planar surface and substantially planar face; positioning the other of the substantially planar surface and the substantially planar face on the spacer elements; and sealing the substrate to the display panel.

BRIEF DESCRIPTION OF THE DRAWING

The foregoing features of the present invention may be more fully understood from the following detailed description, read in conjunction with the accompanying drawings, wherein.

DESCRIPTION OF THE PREFERRED EMBODIMENT

Figure 1:
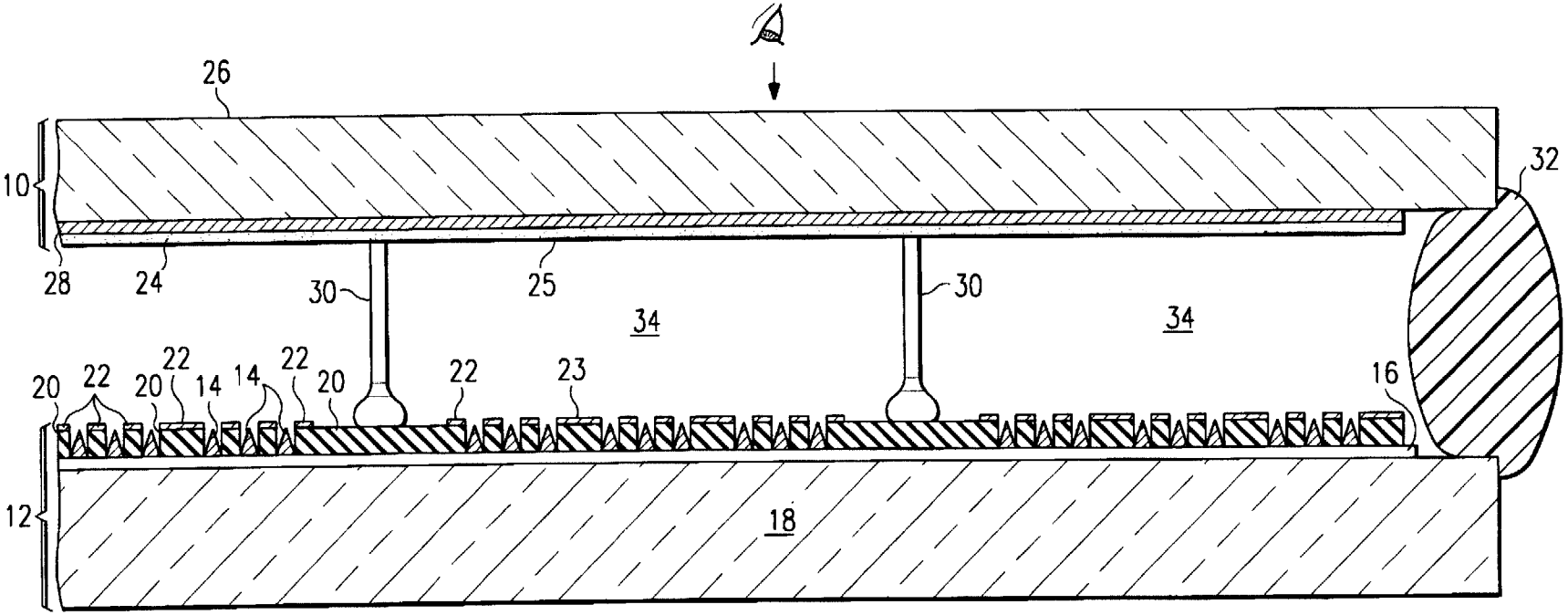
FIG. 1 is a cross-sectional view of a portion of a field emission display device including spacers fabricated according to the present invention.

Referring initially to FIG. 1, there is shown, in cross-sectional view, a portion of an illustrative field emission flat panel display device which includes spacers fabricated in accordance with the present invention. In this embodiment, the field emission display device comprises an anode portion having an electroluminescent phosphor coating facing a cathode portion, the phosphor coating being observed from the side opposite to its excitation.

More specifically, the field emission display device of FIG. 1 comprises a cathodoluminescent anode 10 and a cathode 12. Cathode 12 comprises a plurality of electrically conductive microtips 14 formed on an electrically conductive coating 16, which is itself formed on an electrically insulating substrate 18. Coating 16 may be semiconducting or resistive instead of being conducting.

A gate electrode comprises a coating of an electrically conductive material 22 which is deposited on an insulating layer 20. Microtips 14 take the shape of cones which are formed within apertures through conductive layer 22 and insulating layer 20. The thicknesses of gate electrode coating 22 and insulating layer 20 are chosen in such a way that the apex of each microtip 14 is substantially level with the electrically conductive gate electrode coating 22. Conductive coating 22 may be in the form of a continuous coating across the surface of substrate 18; alternatively, it may comprise conductive bands across the surface of substrate 18. Conductive coating 22 forms a substantially planar surface 23 on cathode structure 12.

Anode 10 comprises an electrically conductive film 28 deposited on a transparent planar support 26 which is positioned facing gate electrode 22 and parallel thereto, the conductive film 28 being deposited on the surface of support 26 directly facing gate electrode 22. Conductive film 28 may be in the form of a continuous coating across the surface of support 26 as shown in FIG. 1; alternatively, it may be in the form of electrically isolated stripes comprising three series of parallel conductive bands across the surface of support 26, as taught in U.S. Pat. No. 5,225,820, to Clerc. By way of example, a suitable material for use as conductive film 28 may be indium-tin-oxide (ITO), which is optically transparent and electrically conductive.

Anode 10 also comprises a cathodoluminescent phosphor coating 24, deposited over conductive film 28 so as to be directly facing and immediately adjacent gate electrode 22. Phosphor coating 24 forms a substantially planar surface 25 on anode structure 10. In the Clerc patent, the conductive bands of each series are covered with a phosphor coating which luminesces in one of the three primary colors, red, blue and green.

Anode 10 and cathode 12 are spaced apart from one another by a plurality of spacers 30 which are shown as columnar members. In a preferred embodiment, spacers 30 comprise rod-shaped glass filaments having enlarged base regions 31. The upper portions of spacers 30 have substantially circular cross sections and are of substantially equal length, although columnar members fabricated of other materials and having other cross-sectional configurations may be used. As an example, spacers 30 may be fabricated of a ceramic material or a metal., as well of glass. By way of illustration, the diameter of the upper portions of spacers 30 may range between 20 and 500 μmeters, and the overall length of spacers 30 may range between 0.05 and 10 millimeters. As used herein, the term "filament" means the individual fibers, threads, rods, strands, strings, posts, columns or canes which provide the spacing function between the opposed faces of anode structure 10 and cathode structure 12.

The material from which spacers 30 are made must have the following qualities. It must have sufficient compressive strength to withstand the force exerted by anode structure 10 against cathode structure 12 in the presence of a vacuum. Second, it must be substantially free from outgassing when in a vacuum pressure of approximately $10^{-7}$ torr. This second quality practically dictates that the material of spacers 30 must be inorganic. Third, it may have to be electrically insulating, capable of withstanding a potential difference of up to approximately 5,000 volts in the application directed to its intended use as described herein. It must also be capable of withstanding the temperature at which anode structure 10 and cathode structure 12 are sealed to one another, typically in the range of approximately 400°–550° C. Finally, the material of spacers 30 must be capable of undergoing the process of attachment to anode structure 10 (or cathode structure 12) which is described in subsequent paragraphs. In the present example, glass is considered the most advantageous material for use as spacers 30.

Anode structure 10 and cathode structure 12 are sealed together at peripheral portions thereof by sealing material 32, illustratively comprising a glass frit rod which reflows at a temperature below the reflow temperature of spacers 30. The reflow temperature of sealing material 32 may be in the range of approximately 400°–550° C.

A heating process, wherein sealing material 32 reflows to seal structure 10 to structure 12, occurs in an environment of an inert gas, preferably argon. After the sealing process, the space 34 between anode structure 10 and cathode structure 12 is evacuated to a pressure of approximately $10^{-7}$ torr through an opening (not shown) in either emitter structure 12 or anode structure 10. Alternatively, the sealing process may be conducted within a vacuum environment, obviating the need for separately evacuating the space between anode structure 10 and cathode structure 12.

Figure 2A:
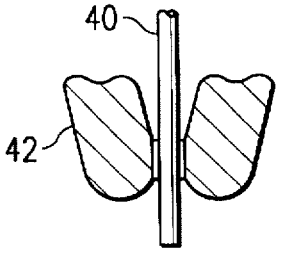
FIGS. 2*a* through 2*e* illustrate a sequence of steps, in accordance with the present invention, for fabricating and assembling spacer elements of the type shown in the field emission display device of FIG. 1.

Referring now to FIGS. 2*a* through 2*e*, there is shown a sequence of steps for fabricating and assembling spacer elements 30 of the type shown in the field emission display device of FIG. 1. FIG. 2*a* illustrates a thin filament 40, illustratively made of glass having a diameter of between 20 and 500 μmeters. Filament 40 is held in the bore of capillary 42 a short distance away from terminal end 41. Capillary 42 is shown in cross section, and the bore through which filament 40 extends is sized such that filament 40 can slide back and forth within it.

Figure 2B:
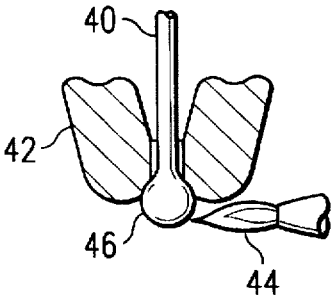

Localized heat is applied to terminal end 41, softening or melting the material of filament 40 and resulting in the formation of a ball structure 46, as shown in FIG. 2*b*. The source of the localized heat may illustratively be the flame of a hydrogen torch 44. In the present example, wherein filament 40 is glass, heating at a temperature of between 400° and 1000° C. for between 1 and 1000 milliseconds is appropriate for adequate melting and formation of ball 46.

Figure 2D:
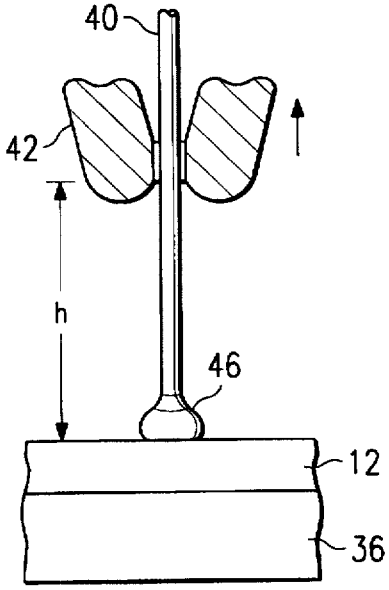
Figure 2C:
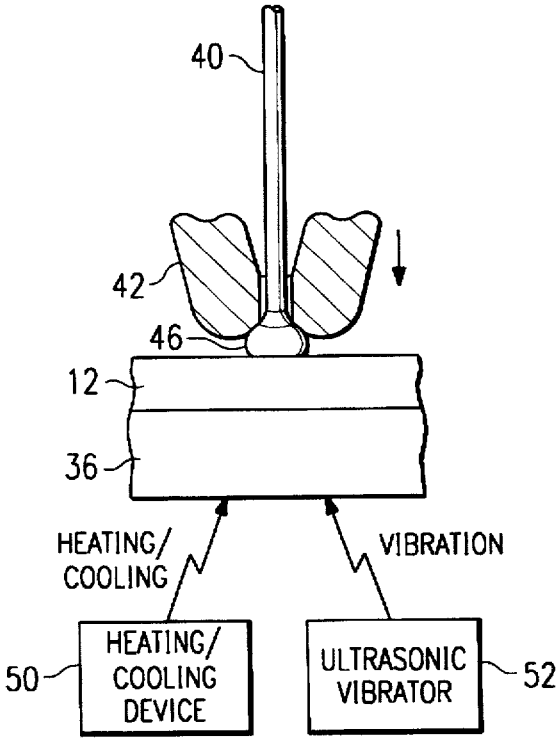

Referring now to FIG. 2*c*, capillary 42 positions filament 40 substantially normal to surface 23 of cathode structure 12 and urges softened ball 46 against a predetermined location on surface 23, deforming ball 46, and causing adhesion to surface 23. In the example shown, cathode structure 12 is mounted on platform 36, which may provide heating and cooling to cathode structure 12 from heating/cooling device 50, and which further may provide ultrasonic vibration to cathode structure 12 from ultrasonic vibrator 52. It is recognized that the process of bonding softened ball 46 to surface 23 may be enhanced by preheating cathode structure 12 to an elevated temperature, typically between 300° and 600° C. It is further recognized that the process of bonding softened ball 46 to surface 23 may be enhanced by subjecting cathode structure 12 to ultrasonic vibration during the bonding process, typically at a frequency of between 30 and 300 kHz.

Figure 2E:
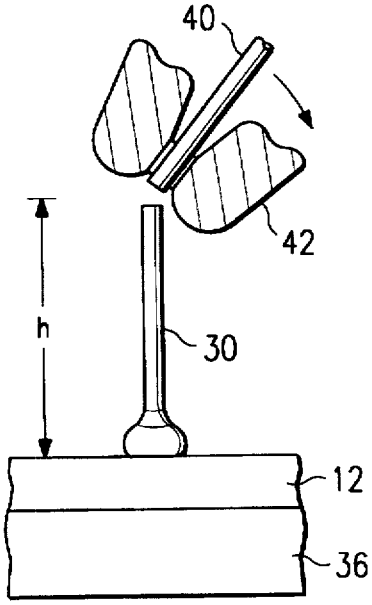

When the bond between ball 46 and surface 23 is firm, capillary 42 slides up filament 40 to a fixed height h above surface 23 of cathode structure 12, as shown in FIG. 2*d*. In the present example, capillary 42 is caused to tilt to one side, as shown in FIG. 2*e*, severing filament 40 at a height h above surface 23, thereby forming upright spacer element 30, of the type shown in FIG. 1. The height h of spacer 30 is illustratively between 0.05 and 10 millimeters.

The process steps described in relation to FIGS. 2*a* through 2*e* are repeated at a multiplicity of locations over surface 23 of cathode structure 12, for as many spacers as are needed to maintain the proper spacing between cathode structure 12 and anode structure 10 (as shown in FIG. 1). The determination of the number of spacers 30 is set, at least, by the material strength of spacers 30 and by the atmospheric pressure load between anode structure 10 and cathode structure 12.

The cycle time of the above process may be reduced by a final step of quickly lowering the temperature of cathode structure 12. Heating/cooling device 50 accomplishes this by cooling platform 36, which in turn quickly reduces the temperature of cathode structure 12.

Finally, anode structure 10 is positioned such that its planar surface 25 rests on the extended ends of spacers 30, and the two structures 10 and 12 are sealed as described above and as shown in FIG. 1.

While the process described in relation to FIGS. 2*a* through 2*e* teaches a technique of affixing spacer elements 30 to surface 23 of cathode structure 12, it should be recognized that essentially the same process can be followed by affixing spacer element 30 to surface 25 of anode structure 10, and subsequently positioning cathode structure 12 such that its planar surface 23 rests on the extended ends of filaments 30. In some instances, this latter process may be deemed preferable.

Figure 3:
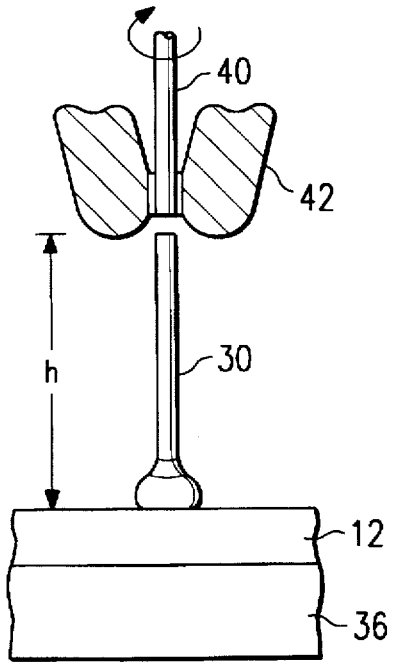
FIG. 3 illustrates a first alternative to the step described in relation to FIG. 2*e.

FIG. 3 illustrates a first alternative to the step of severing filament 40 as described in relation to FIG. 2*e*. In particular, when the bond between ball 46 and surface 23 is firm, capillary 42 slides up filament 40 to a fixed height h above surface 23 of cathode structure 12, and capillary 42 is caused to twist about the axis of filament 40, as shown in FIG. 3, severing filament 40 at a height h above surface 23, thereby forming spacer element 30, of the type shown in FIG. 1.

Figure 4:
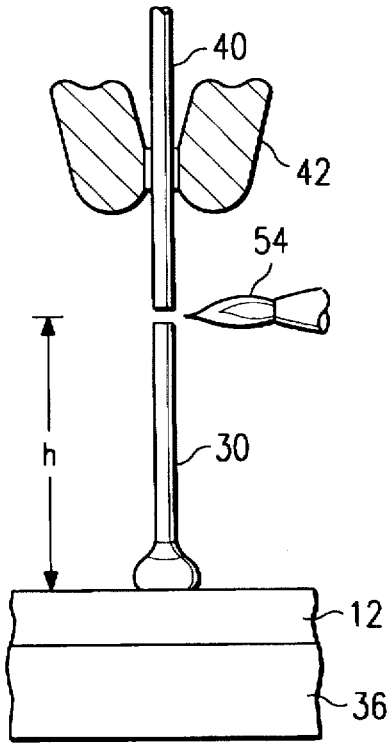
* and FIG. 4 illustrates a second alternative to the step described in relation to FIG. 2*e*.

FIG. 4 illustrates a second alternative to the step of severing filament 40 as described in relation to FIG. 2*e*. In this alternative, when the bond between ball 46 and surface 23 is firm, capillary 42 slides up filament 40 and heat is applied to filament 40 at a fixed height h above surface 23 of cathode structure 12, as shown in FIG. 3, until filament 40 is severed at a height h above surface 23, thereby forming spacer element 30, of the type shown in FIG. 1. The source of the heat may typically be a finely directed flame from a hydrogen torch 54.

A flat panel display device which includes the spacers disclosed herein, the method of forming and assembling the spacers disclosed herein, and the method of assembling a flat panel display device which includes the spacers disclosed herein, overcome many limitations and disadvantages of the prior art display devices and methods. The relatively simple process of forming spacers on one of the substrates in accordance with the present invention is a distinct improvement over the methods used to fabricate the latticework, pillar and leg structures of the prior art, and it is far easier to assemble than the prior art method involving the multiplicity of individual spheres. Furthermore, it permits spacing between display panels of as much as ten millimeters, without occulting a noticeable portion of the display. Hence, for the application to flat panel display devices envisioned here, the approach in accordance with the present invention provides significant advantages.

While the principles of the present invention have been demonstrated with particular regard to the structures and methods disclosed herein, it will be recognized that various departures may be undertaken in the practice of the invention. The scope of the invention is not intended to be limited to the particular structures and methods disclosed herein, but should instead be gauged by the breadth of the claims which follow.

What is claimed is:

1. A method for making a spacer useful for maintaining a fixed spacing between two substantially parallel plates, said method comprising the steps of:

providing a substrate;

melting an end of a fiber held in the bore of a capillary;

urging said melted end against said substrate to form a bond thereon; and severing said fiber at a fixed distance from said substrate.

2. The method in accordance with claim 1 wherein the material of said fiber is selected from the group consisting of glass, ceramic and metal.

3. The method in accordance with claim 1 wherein said fiber has a diameter of between 20 and 500 μmeters.

4. The method in accordance with claim 1 wherein the step of melting an end of said fiber comprises heating said end with a torch flame so as to form a ball at said end.

5. The method in accordance with claim 4 wherein the step of urging said melted end against said substrate includes positioning said capillary so as to apply force on said ball against said substrate.

6. The method in accordance with claim 1 wherein the step of urging said melted end against said substrate further includes ultrasonically agitating said substrate to assist formation of said bond.

7. The method in accordance with claim 1 wherein the step of severing said fiber at a fixed distance from said substrate includes:

positioning said capillary at said fixed distance from said substrate; and tilting said capillary until said fiber is severed.

8. The method in accordance with claim 1 wherein the step of severing said fiber at a fixed distance from said substrate includes:

positioning said capillary at said fixed distance from said substrate; and twisting said capillary until said fiber is severed.

9. The method in accordance with claim 1 wherein the step of severing said fiber at a fixed distance from said substrate includes cutting said fiber with a torch flame.

10. The method in accordance with claim 1 further including, prior to said step of urging said melted end against said substrate, a step of heating said substrate.

11. The method in accordance with claim 1 wherein said fixed distance is in the range between 0.05 and 10 millimeters.

12. A method for making a plurality of spacers useful for maintaining a fixed spacing between two substantially parallel plates comprising repetitions of the method in accordance with claim 1 at various locations on said substrate.

13. A method for fabricating a flat display apparatus comprising the steps of:

(a) providing a substrate having a substantially planar surface;

(b) providing a display panel having a substantially planar face;

(c) providing a spacer element on one of said substantially planar surface and substantially planar face comprising the substeps of:

(i) melting an end of a fiber being held in the bore of a capillary;

(ii) urging said melted end against said one of said substantially planar surface and substantially planar face to form a bond thereon; and (iii) severing said fiber at a fixed distance from said one of said substantially planar surface and substantially planar face;

(d) repeating step (c) at various locations on said one of said substantially planar surface and substantially planar face;

(e) positioning the other of said substantially planar surface and said substantially planar face on said spacer elements; and (f) sealing said substrate to said display panel.

14. The method in accordance with claim 13 wherein the material of said fiber is selected from the group consisting of glass, ceramic and metal.

15. The method in accordance with claim 13 wherein said fiber has a diameter of between 20 and 500 μmeters.

16. The method in accordance with claim 13 wherein the substep of melting an end of said fiber comprises heating said end with a torch flame so as to form a ball at said end.

17. The method in accordance with claim 16 wherein the substep of urging said melted end against said substrate includes positioning said capillary so as to apply force on said ball against said substrate.

18. The method in accordance with claim 13 wherein the substep of urging said melted end against said substrate further includes ultrasonically agitating said substrate to assist formation of said bond.

19. The method in accordance with claim 13 wherein the substep of severing said fiber at a fixed distance from said substrate includes:

positioning said capillary at said fixed distance from said substrate; and tilting said capillary until said fiber is severed.

20. The method in accordance with claim 13 wherein the substep of severing said fiber at a fixed distance from said substrate includes:

positioning said capillary at said fixed distance from said substrate; and twisting said capillary until said fiber is severed.

21. The method in accordance with claim 13 wherein the substep of severing said fiber at a fixed distance from said substrate includes cutting said fiber with a torch flame.

22. The method in accordance with claim 13 further including, prior to said urging said melted end substep, a substep of heating said one of said substantially planar surface and substantially planar face.

23. The method in accordance with claim 13 wherein said fixed distance is in the range between 0.05 and 10 millimeters.

24. The method in accordance with claim 13 further including, prior to said sealing step, a step of evacuating gases from the space between said substrate and said display panel.

* * * * *